US005951345A

United States Patent [19]

Perratone et al.

[11] Patent Number: 5,951,345

[45] Date of Patent: Sep. 14, 1999

[54] VESSEL COMPRISING AN INFLATABLE SEALING ELEMENT

[75] Inventors: René Perratone, Menton, France; Jean Braud, La Turbie, Monaco

[73] Assignee: Single Buoy Moorings Inc., Marly, Switzerland

[21] Appl. No.: 08/934,734

[22] Filed: Sep. 22, 1997

[30] Foreign Application Priority Data

Sep. 20, 1996 [EP] European Pat. Off. ..... 96202635

[51] Int. Cl.[6] ..... B63B 22/02

[52] U.S. Cl. ..... 441/4; 114/230.1

[58] Field of Search ..... 441/3, 4, 5; 114/230

[56] References Cited

U.S. PATENT DOCUMENTS 5,305,703 4/1994 Korsgaard ..... 441/4
5,339,760 8/1994 Korsgaard .

FOREIGN PATENT DOCUMENTS 2 129 795 10/1972 France .
2 348 848 11/1977 France .
2 041 306 9/1980 United Kingdom .
2 291 389 1/1996 United Kingdom .
WO 93/24733 12/1993 WIPO .
WO 94/18065 8/1994 WIPO .

*Primary Examiner*—Jesus D. Sotelo
*Attorney, Agent, or Firm*—Young & Thompson

[57] ABSTRACT

A vessel comprising a detachable buoy (3) which is connected to the vessel near keel level. the buoy or the vessel comprise on their contact surfaces an annular sealing element (6) comprising at least one inflatable tube (7,8,9). By placing the inflatable tube on the contact surfaces, the buoy and the vessel can be firmly connected, even when the contact surfaces are not completely flat. A water tight seal is formed by the inflatable tube such that the room in the top part of the buoy can be drained. Hereby a firm connection is achieved and a dry room becomes available for placing structures such as for instance a manifold system.

6 Claims, 2 Drawing Sheets

1
2
5
6
6'
21
4
3

VESSEL COMPRISING AN INFLATABLE SEALING ELEMENT

FIELD OF THE INVENTION

The invention relates to a vessel comprising a detachable buoy which is connected to the vessel near keel level, the buoy and the vessel each having a contact surface.

BACKGROUND OF THE INVENTION

A tanker comprising a detachable mooring buoy is known from U.S. Pat. No. 4,604,961. The known tanker comprises a turret that can be connected to a mooring buoy by means of a mooring recess in the moonpool of the vessel. The known system has as a disadvantage that for a reliable connection of the buoy to the mooring recess, the contact surfaces must be accurately matched and be machined to a high degree of precision. Furthermore, no water tight seal is established, such that the space near the connecting interface of the vessel and the buoy will be below water level.

SUMMARY OF THE INVENTION

It is an object of the present invention to provide a vessel, wherein the tolerances for the contact surfaces can be relatively large while still obtaining a proper fit. It is a further object of the present invention to provide a vessel with a disconnectable buoy, which can engaged with the vessel in a water tight manner.

There vessel according to the invention is characterized in that the buoy or the vessel comprises on its contact surface an annular sealing element comprising at least one inflatable tube.

By placing the inflatable tube on the contact surface of the buoy or the vessel, the buoy and the vessel can be firmly connected, even when the contact surfaces are not completely flat. The inflatable tube can form a water tight seal,such that the room in the top part of the buoy can be drained. Hereby the buoy will be pressed into its connected position by the water pressure prevailing at the depth of the buoy. Also the room above the buoy can be used to house equipement such as for instance a manifold system, or other structures that are not to be submerged.

The buoy can be any connection body with a certain amount of buoyancy. However, the buoy can also be ballastable and not have any substantial buoyancy. The buoy can be a mooring buoy which is connected to the sea floor by means of anchor lines, or can be a riser support buoy connected to a subsea structure such as a well head.

In one embodiment of a vessel according to the invention, at least two inflatable tubes are located side by side in a radial direction, for improved sealing. Each sealing element may comprise a cross-section having a T-shaped wall part. The transverse wall of the T-shaped part provides a flat sealing surface.

Each inflatable tube may in a radial direction be located between two annular walls for effective sealing, and for keeping the tubes properly positioned. Preferably the sealing element is located on the vessel, each tube being connected to a fluid conduit for inflating the tubes. The source for providing pressurized fluid, such as compressed air, to the tubes is placed in the vessel. The tubes are inflated up to a pressure between about 1 and 10 bar. The diameter of the seals will generally be larger than 2 m.

BRIEF DESCRIPTION OF THE DRAWINGS

An embodiment of a vessel according to the invention will be explained with reference to the accompanying drawing. In the drawings.

DETAILED DESCRIPTION OF THE INVENTION

Figure 1:
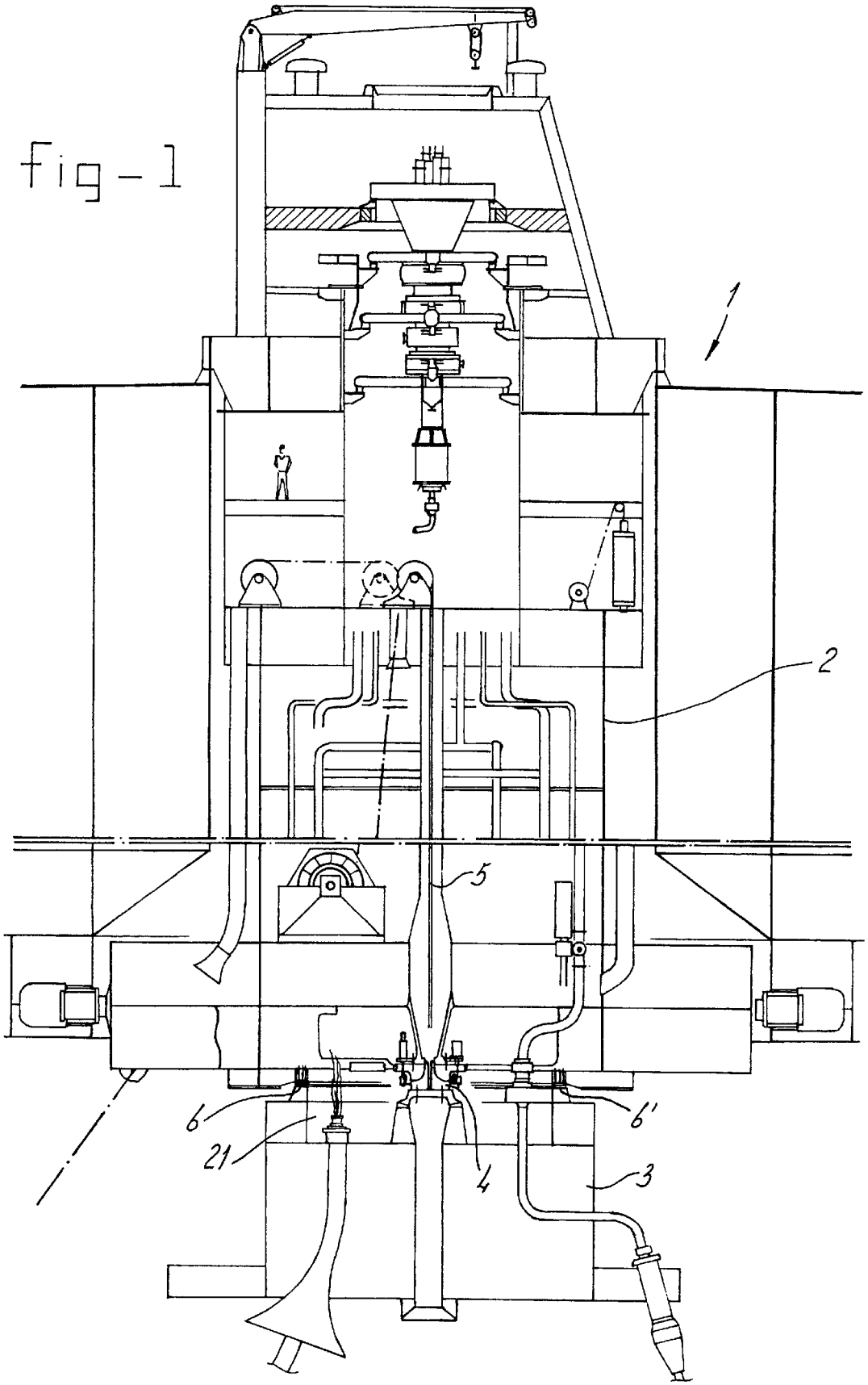
FIG. 1 shows a cross sectional view of a vessel comprising a detachable buoy and a sealing element according to the present invention.
Figure 2:
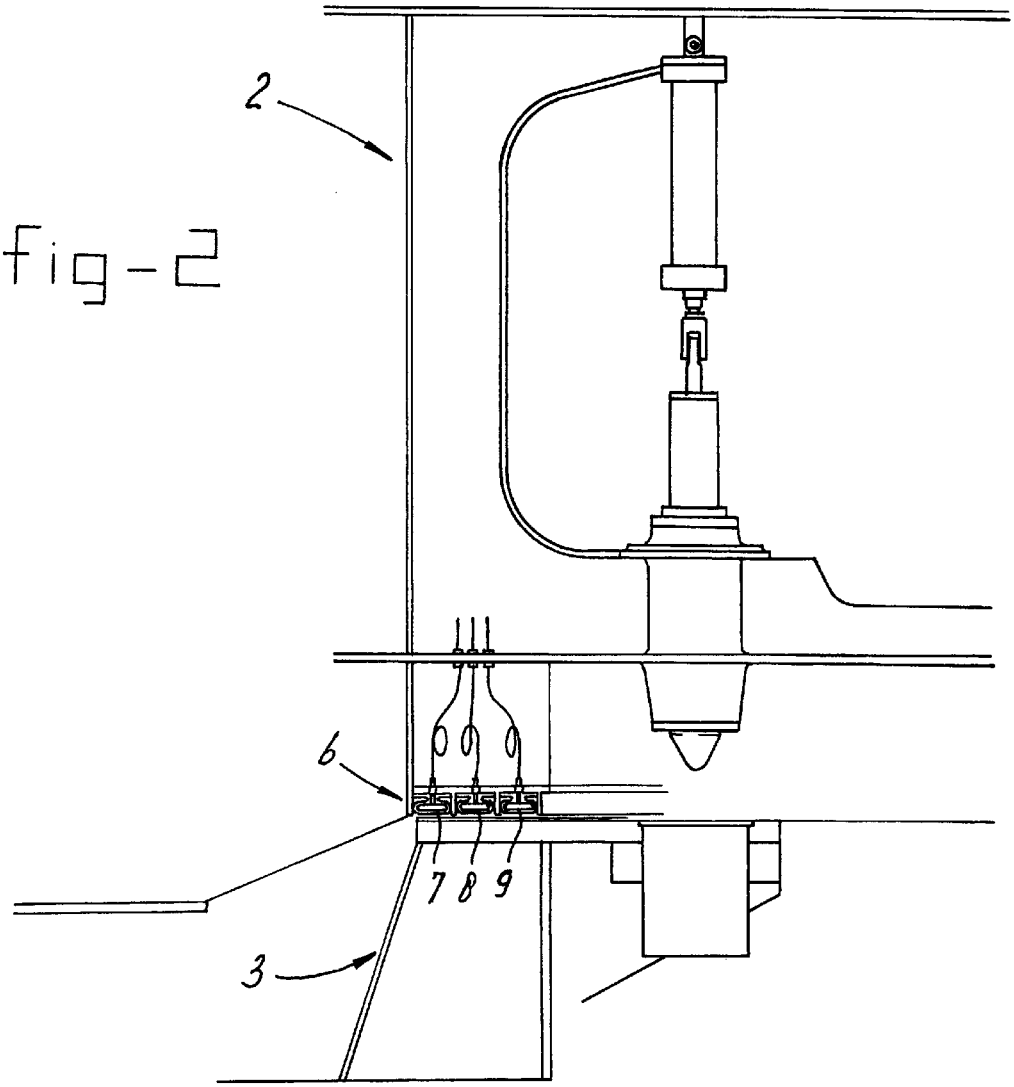
FIG. 2 shows an enlarged cross-sectional view of the sealing element of FIG. 1
Figure 3:
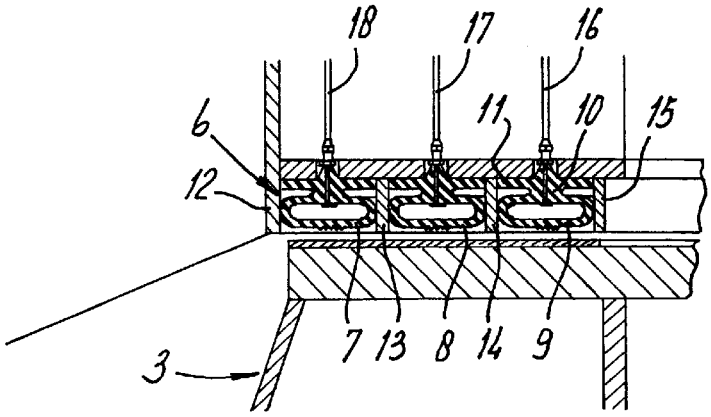
FIG. 3 shows a detail of the inflatable sealing tubes of FIG. 2.

FIG. 1 shows a vessel 1 having a turret 2. To the bottom of the turret, a riser support buoy 3 is connected via a detachable connecting device 4. The buoy 3 can be drawn against the bottom of the turret 2 by means of a cable 5 connected to a winch on the vessel 1. An inflatable sealing element 6,6' is placed on the contact surface of the vessel 1. As can be seen in FIGS. 2 and 3, the sealing element comprises three inflatable tubes 7,8,9. The tubes are circular and have a diameter that may for instance be larger than 2 m. The tubes 7,8,9 have a cross-section comprising a T-shaped part 10 with a flat wall part 11. The tubes 7,8,9 are each located between respective annular walls 12,13,14,15. Each tube is connected to a fluid conduit 16,17,18 which are attached to a fluid source on the vessel. After connecting the buoy 3 to the turret 2, the room 21 inboard from the sealing element 6,6' can be drained such that the buoy attaches firmly to the vessel and the connectors in the room 21 are not submerged.

We claim:

1. Vessel comprising a detachable buoy which is connected to the vessel near keel level, the buoy and the vessel each having a contact surface, wherein the buoy or the vessel comprises on its contact surface an annular sealing element comprising at least one inflatable tube, the sealing element being positioned between two spaced apart abutment members, the sealing element being in its deflated state located below a contact surface of the abutment members.

2. The vessel according to claim 1, wherein at least two inflatable tubes are located concentrically.

3. The vessel according to claim 1, wherein each sealing element comprises a cross-section having a T-shaped sealing wall.

4. The vessel according to claim 1, wherein the two spaced apart abutment members comprise two annular walls.

5. The vessel according to claim 1, wherein the sealing element is located on the vessel, and each tube is connected to a fluid conduit for inflating the tubes.

6. The vessel according to claim 1, further comprising a room located above the buoy and a pump for substantially freeing the room of water after connecting the buoy to the vessel.

* * * * *